United States Patent [19]

Roth

[11] 4,035,610

[45] July 12, 1977

[54] FURNACE CABINET HAVING INTEGRAL HEATER AND BLOWER ASSEMBLIES

[75] Inventor: James E. Roth, Festus, Mo.

[73] Assignee: Intertherm, Inc., St. Louis, Mo.

[21] Appl. No.: 638,340

[22] Filed: Dec. 8, 1975

[51] Int. Cl.[2] ..... F24H 3/02

[52] U.S. Cl. ..... 219/366; 219/370; 219/375; 126/110 R; 165/122; 415/219 C; 417/423 R

[58] Field of Search ..... 219/366, 370, 369, 374, 219/371, 367, 368, 375, 376, 360; 417/423; 415/219 C, 204, 206; 165/122, 121; 126/110 R, 110 B

[56] References Cited

U.S. PATENT DOCUMENTS

| | | | |
|---|---|---|---|
| 2,361,007 | 10/1944 | Buchanan | 219/370 UX |
| 2,526,884 | 10/1950 | Larkin | 219/364 X |
| 2,552,470 | 5/1951 | Wahlberg | 219/366 X |
| 2,675,460 | 4/1954 | Winner | 219/375 X |
| 2,855,641 | 10/1958 | Stein | 417/423 R |
| 2,971,076 | 2/1961 | Ferguson | 219/374 X |
| 2,988,626 | 6/1961 | Buttner | 219/368 X |
| 3,746,464 | 7/1973 | Goettl | 417/423 R |
| 3,960,527 | 6/1976 | Goettl | 417/423 R |

*Primary Examiner*—Bruce A. Reynolds
*Assistant Examiner*—M. Paschall

[57] ABSTRACT

Instead of constructing an air furnace cabinet as a separate unit and then installing the furnace components such as electrical heating elements, controls and a blower, in the present invention a blower scroll assembly and a heating element assembly are first constructed using flanged sheet metal panels as wide as the interior of the cabinet. The cabinet is then assembled about and integrally reinforced by these assemblies. Lines of securement of the flanges of these assemblies divide the exterior cabinet walls into smaller parts and afford to the cabinet strength and structural rigidity.

5 Claims, 4 Drawing Figures

FURNACE CABINET HAVING INTEGRAL HEATER AND BLOWER ASSEMBLIES

BACKGROUND OF THE INVENTION

This invention relates to air delivery appliance cabinets, such as those of electric furnaces, of the type in which air, entering through an upper or lower end of the cabinet, is delivered by a centrifugal blower past temperature-affecting elements such as heater coils within an air casing.

It is conventional practice to construct such a cabinet of sheet metal with structural reinforcements sufficient to strengthen the cabinet and stabilize it against forces which would deflect it from its rectangular shape. After such cabinets are constructed, the elements to be accommodated, including a separately fabricated blower scroll, air casing, controls and other components, are installed on brackets and fittings at considerable expense for construction and installation.

SUMMARY OF THE INVENTION

The principal purpose of the present invention is to provide a single furnace cabinet which forms a unit with its heater and blower assemblies so that such assemblies themselves supply strength and rigidity to the walls of the cabinet. An additional purpose is to provide combined cabinet and centrifugal air delivery system, the cabinet being internally stabilized by the air delivery components. A still further purpose is to provide such a furnace with a door which not only adds stability to the cabinet but when in place serves as part of an inlet air chamber and which on removal gives access to the blower inside the air delivery system. Still further purposes will be apparent from the detailed specification which follows.

Briefly summarizing, and without limiting the scope hereof, in the present invention two preliminary assemblies are made. One of them, the blower scroll assembly, includes lateral vertical scroll panels which, at their extremity remote from the air inlet end of the cabinet, have parts which extend forward or aft to the corresponding extremities of the cabinet. The panels are of such width that when the flanges of their sides are joined to the side walls, they divide them into smaller portions and the panels serve as structural webs across the cabinet. The aft extending part of the aft scroll panel similarly divides the rear wall.

These lateral scroll panels have circular inlets in which a blower wheel is received. A scroll wall between the two panels, curved to the shape of a conventional centrifugal blower scroll, has a horizontal outlet which is in vertical registration with the air casing of a second assembly, referred to as the heater element assembly. This assembly includes conventional heater unit means, such as resistance heater elements positioned within the air casing, mounted on a vertical control panel whose side edges are flanged and which has, along its extremity remote from the air inlet, a forwardextending part whose edges are likewise flanged.

The principal cabinet walls ar left and right side walls and a rear wall which establishes their spacing. At their air inlet end they are flanged inwardly. With their front corners connected by a joining piece an air inlet is provided to the blower scroll assembly, which is fastened by its flanges adjacent to this end. An access door having 90° flanges confines the otherwise free forward edges of the side walls; and where it encloses the forward scroll panel, it completes a forward air inlet chamber through which air passes into the scroll of the blower. Removal of this door gives access to the motor-driven blower mounted in the scroll.

Air which enters through the inlet end of the cabinet into the air inlet chambers forward and aft of these two scroll panels passes through their openings and is driven by the blower through the vertical air casing of the heater element assembly. The air then passes through a conventional outlet.

This manner of assembling the cabinet about the blower and heater assemblies produces a unitary furnace, assembled with a minimum of parts and effort, in which the panels on which the blower and heater units are mounted serve as rigid reinforcing webs extending both horizontally and vertically. The flanges of these webs are readily secured to the cabinet walls by conventional means such as simple lines of screws. These webs and their lines of securement to the walls afford adequate strength and structural rigidity to the cabinet.

DESCRIPTION OF THE PREFERRED EMBODIMENT

Figure 1:
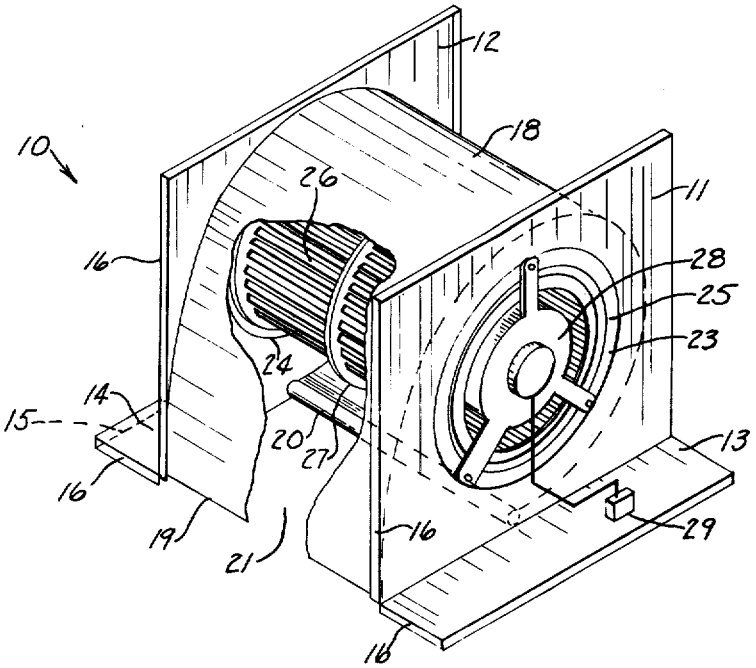
FIG. 1 is a perspective view, partly broken away, of a centrifugal blower assembly constructed in accordance with the present invention.

The present invention is illustrated in the simple electric furnace shown in the drawings, in which the cabinet is formed of lightweight sheet metal pieces secured about, and internally reinforced by, the blower and heater unit assemblies shown. These assemblies are first constructed separately.

The blower assembly generally designated 10, shown in perspective in FIG. 1, includes a scroll assembly comprised of a forward vertical scroll panel 11 and an aft vertical scroll panel 12, both of which extend the full width between the side walls of the cabinet, to be described hereafter. Both the scroll panels 11, 12 are L-shaped, the forward scroll panel 11 having along its lower edge a forward-extending part 13 which extends to the forward edges of said cabinet side walls, and the aft scroll panel 12 having a similar portion 14 extending rearward and terminating in a flanged rear edge 15 which on assembly is to be secured to the rear cabinet wall. The side edges of the scroll panels 11, 12, including the side edges of their substantially horizontal portions 13, 14, have similar flanges 16, to be ultimately secured to the cabinet side walls.

In the furnace illustrated the return air inlet is at the top; by locating the forward and aft extending portions 13, 14 of the front and rear scroll panels 11, 12 at the extremities of the scroll panels 11, 12 remote from such air inlet, they serve as parts of air inlet chambers, as hereinafter described.

In the assembly illustrated in FIG. 1, the scroll panels 11, 12 are maintained parallel to each other by a scroll-shaped wall 18, to which the panels 11, 12 are secured by conventional fasteners, not shown. This scroll-shaped wall 18 rises vertically from a left outlet edge 19 and curves, at a radius which becomes progressively smaller, to the right as shown and then downward and back partly to the left to a reverse curved right outlet edge 20 also coincident with the lower extremities of the scroll panels 11, 12. The space in the horizontal plane between the left outlet edge 19 and the right outlet edge 20 serves as the blower outlet 21.

Inlets to the blower scroll assembly 10 are provided by circular openings 23, 24 into the forward and rear scroll panels 11, 12 respectively. The centers of these openings 23, 24 are the centers about which the varying-curvature scroll wall 18 is curved. Each of the openings 23, 24 is fitted with a conventional stream-flow inlet baffle 25. Within the forward opening 23 a blower motor 28 is mounted. Between the forward and rear panel circular openings 23, 24 is a conventional centrifugal blower wheel 26 whose supporting disk 27 is mounted on the shaft of the blower motor 28. An electrical connector leads from the motor 28 to a socket 29 mounted in the forward extending part 13.

Figure 2:
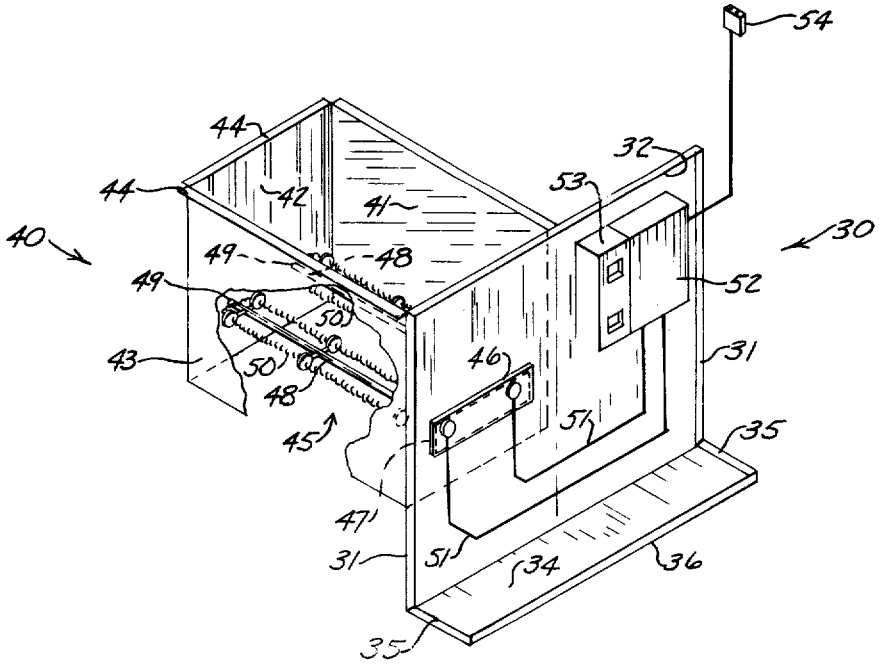
FIG. 2 is a similar perspective view of an electric heating element assembly constructed in accordance with the present invention.

FIG. 2 illustrates a heating unit assembly, likewise made up prior to the assembly of the furnace. A heater control panel generally designated 30 is to be oriented vertically beneath the forward scroll panel 11; its width is equal to the width of the scroll panels 11, 12; its vertical side edges have flanges 31, and preferably its upper edge has a similar flange 32. At its extremity which is to be remote from the cabinet air inlet — that is, lower edge — it has a forward extending part 34 whose side edges have flanges 35 and whose forward edge has a flange 36, all extending upwardly.

Mounted to the aft side of the control panel 30, in a position substantially in vertical registration with the blower scroll outlet 21, is an air casing generally designated 40 whose upper and lower ends are open. The vertical walls of the air casing 40 are to be oriented beneath the edges of the blower outlet 21; they consist of a portion of the control panel 30, a right air casing wall 41 which extends aft an amount substantially equal to the spacing between the scroll panels 11, 12, a rear air casing wall 42, and a left air casing wall 43 each having 90° flanges 44. The flange 44 on the left casing wall 43 positions it slightly inward of the cabinet wall 64.

The lower part of the air casing 40 accommodates a removable heating unit means generally designated 45. It includes a forward vertical closure wall 46 which closes against a rectangular opening 47 in the control panel 30. Borne by the forward vertical closure wall 46 are a pair of rearward-extending support rods 48 whose tips are supported in small apertures 49 in the rear wall 42 of the air casing 40. The support rods 48 support conventional electric resistance heater coils 50, current to which is supplied through connectors 51 from a fuse box 52 mounted on the control panel.

Mounted adjacent to the fuse block 52 is a disconnect socket receptacle 53. Connectors extending from the fuse block 52 lead to a plug 54 by which current is furnished to the blower motor 28 when connected to the socket 29. The disconnect socket receptacle 53 receives a disconnect plug generally designated 56, shown in FIG. 4, to be inserted through the door of the cabinet, hereafter described, when the door is in place.

Figures 3, 4:
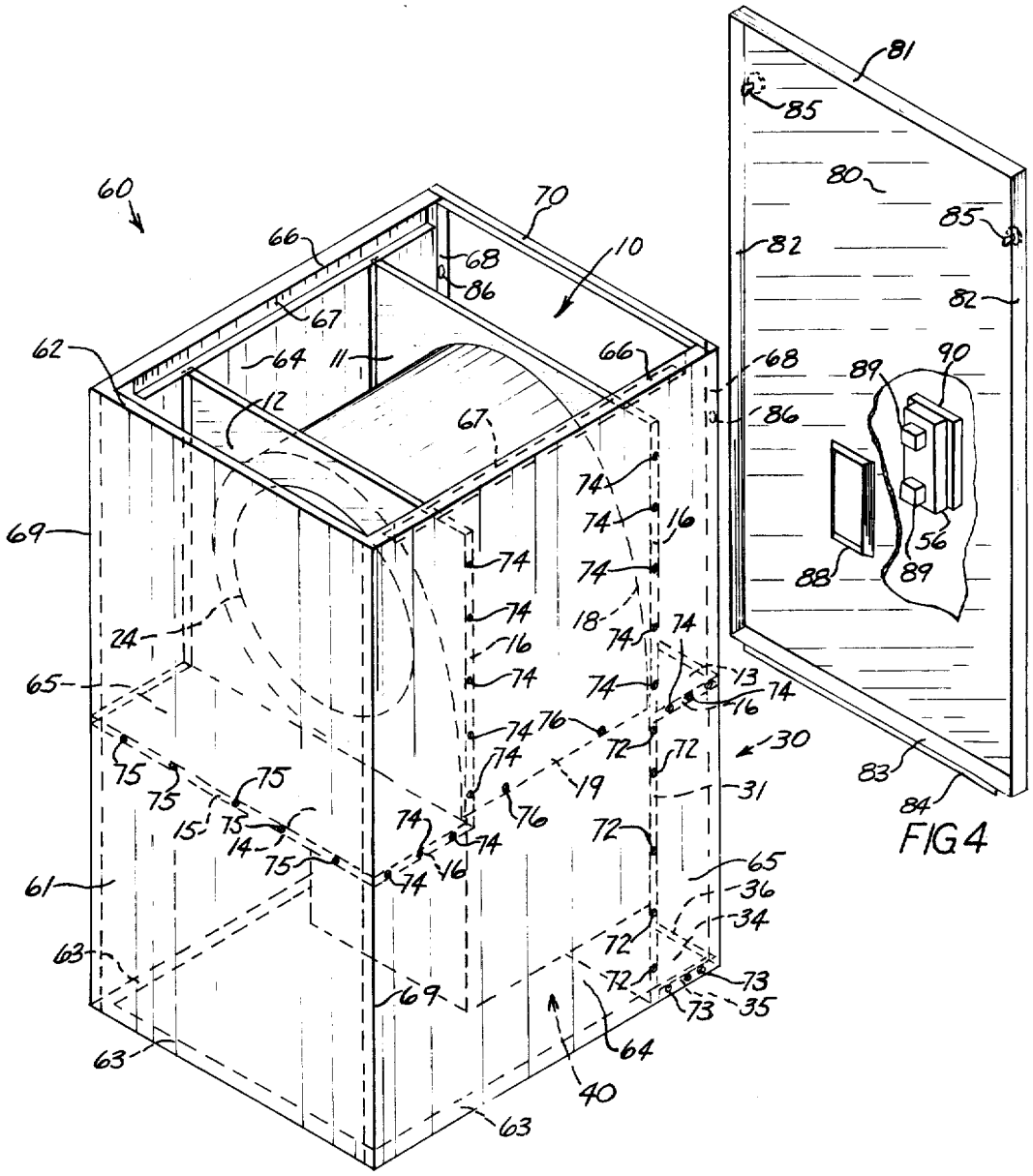
FIG. 3 is a perspective view, as seen from the rear and above, of the said assemblies as incorporated in a cabinet formed thereabout in accordance with the present invention.
FIG. 4 is an exploded perspective view of a door for the cabinet of FIG. 3, seen from the rear, partly broken away and with the safety disconnect shown removed therefrom.

Cabinet walls are simple fabricated of light sheet metal to form the sheet metal cabinet generally designated 60 best seen in FIG. 3. A rear wall 61 has an inward formed top flange 62 and bottom flange 63. The left and right side walls 64, 65 respectively are so designated with reference to their positions as if seen from the front of the cabinet. Each has an upper edge flange 66 which extends inward. Commencing several inches from the front and rear edges of these side walls 64, 65, their upper edge flanges 66 have extension margins 67 which are flanged downward and further inward, to support an air inlet filter, not shown. The forward and bottom edges of the side walls 64, 65 have inward-turned flanges 68, 63.

A simple angle bracket 70 extends laterally across the top forward edges of the side walls 64, 65, joining the forward edges of their upper flanges 66 to form the upper corner of the cabinet. By it, and by the inner edges of the upper flanges 66 on the side walls 64, 65 and of the upper flange 62 of the rear wall 61, a return inlet opening is formed.

Under conventional practice, cabinet walls would be secured to each other and reinforced to provide a complete rigid cabinet before introducing the heating and blower elements. With the present invention, the order of assembly is dictated solely be convenience. Thus the heater assembly mounted on the heater control panel 30 and the blower assembly 10 mounted on the scroll panels 11 and 12 may conveniently be assembled to the side walls 64, 65 even before attaching the rear wall 61. For this reason vertical joints 69 between the side walls 64, 65 and the rear wall 61 are preferably made according to practices conventional in the sheet metal duct-making field. Most desirable is a type of joint which secures itself on the parts being pressed together, such as the popular "button-lock" joint, not illustrated.

The outlet end of the heater assembly air casing 40 is spaced above the bottom of the furnace cabinet. The air outlet of the cabinet itself is bounded by the inner edges of the bottom flanges 63 of the rear wall 61 and the side walls 64, 65, as well as the forward-extending part 34 of the heater control panel 30.

As seen from FIG. 3, the cabinet walls 61, 64, 65 are reinforced by the heater control panel 30, the blower scroll panels 11, 12 and their forward and aft extending parts 13, 14, secured by conventional fastening means such as sheet metal screws. To strengthen the lower cabinet, screws 72 secure the side edge flanges 31 of the control panel 30, while screws 73 attach the side flanges 35 of its forward extending part 34 so that it serves as a rigid forward bottom member of the cabinet.

To strengthen the upper part of the cabinet, the blower scroll assembly 10 is installed by similarly fastening its side edge flange 16 with screws 74 through the cabinet sidewalls 64, 65; and screws 75 secure the rear edge flange 15 of the rearward extending part 14 of the rear scroll panel 12 to the cabinet rear wall 61. Additionally, along its left outlet edge 19 the scroll shaped wall 18 is secured to the left cabinet wall 64 by screws 76. As a further assembly step, the upper edge flange 32 of the control panel 30 may be secured by similar screws beneath the forward extending part 13 of the forward scroll panel 11, and the flange 44 on the rear heat exchanger wall 42 is secured to the part 14.

The cabinet so formed is internally reinforced by what are in effect rigid structural webs, including, as vertical webs, the forward and aft scroll panels 11, 12 and the heater control panel 30, and, as horizontal webs, the forward extending part 34 of the heater control panel 30 and the forward and aft extending parts 13, 14 of the scroll panels 11, 12. From a structural standpoint they serve to "divide" the sheet metal wall into strong smaller panels, and prevent the cabinet from being distorted out of its rectangular shape.

The cabinet is completed by a door 80 shown in perspective in FIG. 4, likewise formed of light gage sheet metal. It has a top edge flange 81 and left and right edge flanges 82 bent back at 90°. A similar lower flange 83 is cut away at its ends, and terminates in a downward bent inner margin 84, adapted to fit behind the forward flange 36 of the forward extending part 34 of the control panel. After inserting downward margin 84 behind this forward flange 36, the door 80 is pressed in place so that its side flanges 82 overlap closely the forward edges of the cabinet side walls 64, 65 and its top edge flange 81 overlaps the cabinet forward edge angle 70. The door 80 is retained in place by simple fasteners such as the conventional twist-locking fasteners 85 whose rearward extending pin portions may lock through bores 86 in the forward flanges 68 of the side walls 64, 65.

That portion of the door immediately outward of the disconnect receptacle 53 is bent inward to form a recessed windowed aperture 88. Through this aperture is inserted the contact-making prong portions 89 of the disconnect plug 56, which are received within the disconnect receptacle 53 to make the electrical circuit from a power source, not shown, to the fuse block 52. The insulated grasping handle 90 of the disconnect plug 56 is larger than the windowed aperture 88; it must be removed to permit removal of the door 80. Thus the furnace is rendered safe for repairment. Removal of the door 80 affords access to all the electrical components which may require replacement or repair.

When the door 80 is so mounted onto the cabinet, it affords further stiffness to resist sideward forces, because of the grasp of its flanges 81, 82 on the cabinet's forward edges thereunder. When the door is so mounted in place, it is close to the forward extending part 13 of the forward scroll panel 11, to provide therebetween an inlet chamber for return air flowing to the opening 23 of the forward scroll panel 11. A similar air inlet chamber which permits flow to the rear scroll panel opening 24 is provided aft of the scroll panel 12, between it and the rear cabinet wall 61. Conventional means may be added to ventilate the control panel 30, such as diverting a small flow of air outward above the closure wall 46.

Thus, with a minimum of parts and assembly labor, a sturdy furnace is provided in which the cabinet structure is integral with heating and blower components.

One obvious adaptation of the present invention is to so extend the height of the cabinet as to accept beneath the air casing 40 a conventional air conditioning unit, with appropriate controls. In such an adaptation, the position of the forward extending part 34 would be above the air conditioning unit, and other conventional means would be utilized to reinforce the base of the cabinet. The manner of securement of the blower and heater subassemblies to the cabinet walls may of course be varied as long as effective lines of attachment are afforded so as to yield the same structural advantages as here outlined. If desired, such attachment may be permanent as by spot welding: because the components subject to wear, such as the blower motor 28, resistance heaters 50 and fuses 52 may be readily replaced even though their structural assemblies are permanently mounted. Other modified forms of the present invention will from this disclosure be apparent to persons skilled in the art.

I claim:

1. An internally stabilized air delivery appliance cabinet, comprising a rear wall, and right and left side walls having aft edges secured thereto and having forward edges, said walls, having, at one of their common extremities, edges defining three edges of a cabinet air inlet, together with a blower scroll assembly located in said cabinet and positioned aft of said forward edges, the blower scroll assembly having a flanged-edge forward scroll panel extending between the said side walls substantially parallel to said rear wall and commencing spacedly from such cabinet air inlet, said forward scroll panel having a forward-extending flanged-edge part at its extremity remote from such cabinet air inlet and extending to the forward edge of the cabinet side walls, all said flanged-edge parts being secured to said side walls, a parallel rear scroll panel similarly secured to the said side walls having a flanged-edge part at its extremity remote from such cabinet air inlet and extending rearward to a flanged aft edge secured to the rear wall, circular scroll openings through said forward and rear scroll panels, whereby a motor-driven centrifugal blower may be accommodated therebetween and its motor may be accommodated at the opening of said forward panel, a scroll-shaped wall mounted about said aligned openings and connecting said forward and rear scroll panels and having between said scroll panels an outlet in a horizontal plane coincident with the forward and rearward flanged-edge parts of said scroll panels, whereby the space between said rear wall and rear scroll panel above its rearward extending flanged-edge part may serve, together with the space thereabove, as a rear air inlet chamber portion, together further with a forward door element covering that portion of the cabinet defined substantially by the forward edges of said left and right sidewalls extending from that extremity at which such cabinet air inlet is located to the forward-extending flanged-edge part of said forward scroll panel, whereby, on its affixation, to complete an air inlet chamber portion forward of said forward scroll panel and on its removal to give access to such motor-driven blower.

2. An internally stabilized air delivery appliance cabinet as defined in claim 1, wherein the forward edges of said left and right side walls have inward-facing flanges, and the forward door element has flanges formed rearward at 90° angles on at least three sides, together with means to so affix said forward door element to the inward-facing flanges of said left and right sidewalls that its flanges overlap the external margins of the cabinet, whereby the door element affords stiffness to the cabinet.

3. A warm air furnace of the type including a rectangular cabinet and having a return air inlet at one of its cabinet ends and being reinforced by its furnace components, comprising A. a blower scroll assembly including a forward scroll panel commencing adjacent to such air inlet and having side edges flanged, and having along its extremity remote from such air inlet end a forward-extending part whose side edges are similarly flanged, a parallel rear scroll panel commencing adjacent to such air inlet and having its side edges flanged, and having along its extremity remote from such air inlet end a rearward extending part whose side and rear edges are similarly flanged, circular scroll openings through the said forward and rear scroll panels, a scroll-shaped wall mounted about said circular scroll openings connecting said forward and rear scroll panels, the scroll-shaped wall defining between said panels an outlet in a plane coincident with the said forward and rearward-extending parts, whereby to provide flow communication from such air inlet to at least one of said scroll openings and thence to said outlet, together with a motor mounted at said opening of said forward scroll panel and a centrifugal blower mounted on the shaft of said motor and accommodated between said scroll panel openings, B. a heating element assembly including heater unit means positioned adjacent to and at least partly in registration with said blower scroll outlet, and a heater control panel by which said heater unit is so positioned, said panel being in substantial planar alignment with said forward scroll panel and being of a width equal to said scroll panels and having its edges flanged and having along its extremity remote from such return air inlet a part extending forwardly a width substantially equal to that of the forward-extending part of said forward scroll panel and whose side edges are flanged, C. cabinet walls including a rear wall whose width equals that of said scroll and control panels, right and left side walls whose width equals the total of that of the forward-extending part of the forward scroll panel, the rearward-extending part of the rear scroll panel, and the scroll-shaped wall between said panels, and whose aft edges are secured to said rear wall and having forward edges joined at said return air inlet end by joining means, means at said end to provide inlet air flow, and means remote from said air inlet end to provide an air outlet, and removable door means normally secured opposite to said rear wall, whereby to serve as a forward cabinet wall, together with D. means to provide lines of securement along the junctures of the aforementioned flanged edges of said blower scroll assembly with the said rear wall and side walls there-adjacent, and of the flanged edges of said heater element assembly with the sidewalls thereadjacent, whereby the panels and extending portions of said assemblies provide strength and rigidity to said cabinet walls.

4. A warm air furnace as defined in claim 3, wherein the said heater unit means of said heating element assembly comprises a heating element and a walled air casing thereabout at the rear side of said heater control panel and having an open end adjacent to and substantially in alignment with the said blower scroll outlet, the air casing end opposite that being likewise open.

5. A warm air furnace as defined in claim 3, in which the said left and right side walls extend to such return air inlet end of the furnace, and are there flanged inwardly, and have inner margins which are flanged away from said end and further inward, whereby to provide, at such air inlet end, left and right edge supports for a filter thereat.

* * * * *